US006234954B1

(12) United States Patent
Mackin

(10) Patent No.: US 6,234,954 B1
(45) Date of Patent: May 22, 2001

(54) INFANT CARE APPARATUS WITH REMOVABLE DOOR

(75) Inventor: Michael H. Mackin, Ellicott City, MD (US)

(73) Assignee: Datex-Ohmeda, Inc., Tewksbury, MA (US)

( * ) Notice: Subject to any disclaimer, the term of this patent is extended or adjusted under 35 U.S.C. 154(b) by 0 days.

(21) Appl. No.: 09/503,065

(22) Filed: Feb. 12, 2000

Related U.S. Application Data

(60) Provisional application No. 60/170,277, filed on Dec. 11, 1999.

(51) Int. Cl.[7] ..... A61G 11/00
(52) U.S. Cl. ..... 600/22
(58) Field of Search ..... 600/22, 21; 16/221, 16/87 R, 222, 227; 292/341.16; D24/163; 119/311

(56) References Cited

U.S. PATENT DOCUMENTS 3,878,570 * 4/1975 Donnelly ..... 600/22
4,191,174 * 3/1980 Martin ..... 600/22
4,361,137 * 11/1982 Grosholz ..... 600/22
4,936,824 6/1990 Koch et al. .
5,112,293 * 5/1992 Vaccaro ..... 600/22
5,649,896 * 7/1997 Barsky ..... 600/22
5,810,709 * 9/1998 Simenauer et al. ..... 600/22
6,049,924 * 4/2000 Prows et al. ..... 600/22
6,155,970 * 12/2000 Dykes et al. ..... 600/22

* cited by examiner

*Primary Examiner*—Eric F. Winakur
*Assistant Examiner*—Brian Szmal
(74) *Attorney, Agent, or Firm*—Roger M. Rathbun

(57) ABSTRACT

An infant care apparatus is provided that has easily removable side doors. The doors have hinges with bores and pie shaped openings extending outwardly from the bores. A bar secures the doors to the infant care apparatus and that bar has a plurality of grooves that readily pass through the pie shaped openings. The diameter of the bar is such as to snugly fit within the bore and be held therein. The bar is movable with respect to the door hinges so that the bar can be moved from one position where the bar is fitted within the bores to sturdily affix the door to the infant apparatus and to another position where the grooves are aligned with the bores and where the door can be detached and reattached by sliding the grooves through the pie shaped openings. In the preferred embodiment, the bar is spring biased along its axis so that it can be moved in either direction along its axis to allow the door to be removed and reattached.

9 Claims, 4 Drawing Sheets

INFANT CARE APPARATUS WITH REMOVABLE DOOR

RELATED APPLICATIONS

This application is based upon Provisional Patent Application Ser. No. 60/170,277 filed Dec. 11, 1999.

BACKGROUND

The present invention relates to an infant care apparatus and, more particularly, to an incubator having removable doors.

There are, of course, various infant incubators currently in use and all typically comprise an infant compartment within which the infant is positioned in a protective heated environment. There are normally a plurality of walls that are used to surround and enclose the infant and a hood atop of the walls to create that protective environment and to isolate the infant within the infant compartment where that environment is controlled.

It is, obviously, necessary to access the infant within the infant compartment from time to time to carry out an intervention on the infant or simply to place the infant within the infant compartment or remove the infant therefrom. Thus there are movable walls or doors to provide that access. Again, as it typical, the doors are hingedly affixed to the base of the infant compartment and swing outwardly and downwardly to a position where the doors are out of the way of the personnel attending to the infant.

It is necessary, from time to time, to remove the doors fully for cleaning nursing care and during which time, the door is separated from its hinged engagement with the incubator base or chassis. Since the need for cleaning the doors occurs frequently, it is preferable that the doors be capable of being disengaged from the hinge assembly easily, without the need for special tools or the need for maintenance personnel to carry out that removal.

Thus, it is preferable that the door removal be carried out easily by any person responsible for the cleaning or nursing care with a minimum of tools and disruption to the incubator. On the other hand, the hinge assembly or other attachment means must, obviously, safely secure the door to the incubator so as to maintain the integrity of the infant compartment enclosing the infant therein. Thus, it would be desirable to provide an infant incubator having pivotally affixed doors that can be removed easily with a minimum of effort and yet be firmly affixed to the incubator so as to not become disengaged inadvertently.

It would be further preferable for the doors to be readily removable by the user with a simple action using either hand to carry out that disengagement easily and positively.

SUMMARY OF THE INVENTION

Accordingly, the present invention relates to an infant incubator having doors that are pivotally affixed to the infant platform supporting the infant to allow access to the infant and which are easily removable by a simple mechanism that firmly secures the doors in place during use but can be removed readily for cleaning or nursing care.

In accordance with the present invention, a simple button can be depressed to fully remove the door from the incubator an thus can be manipulated simply for such removal and yet, the door removal mechanism is not easily activated inadvertently or by accident and, when holding the door, provides a secure mechanism to retain the door pivotally in place to the incubator. The mechanism allows the button that is used for such door removal to be activated by either hand, that is, from either side of the incubator, for the removal of the door.

These and other features and advantages of the present invention will become more readily apparent during the following detailed description taken in conjunction with the drawings herein.

DETAILED DESCRIPTION OF THE INVENTION

Figure 1:
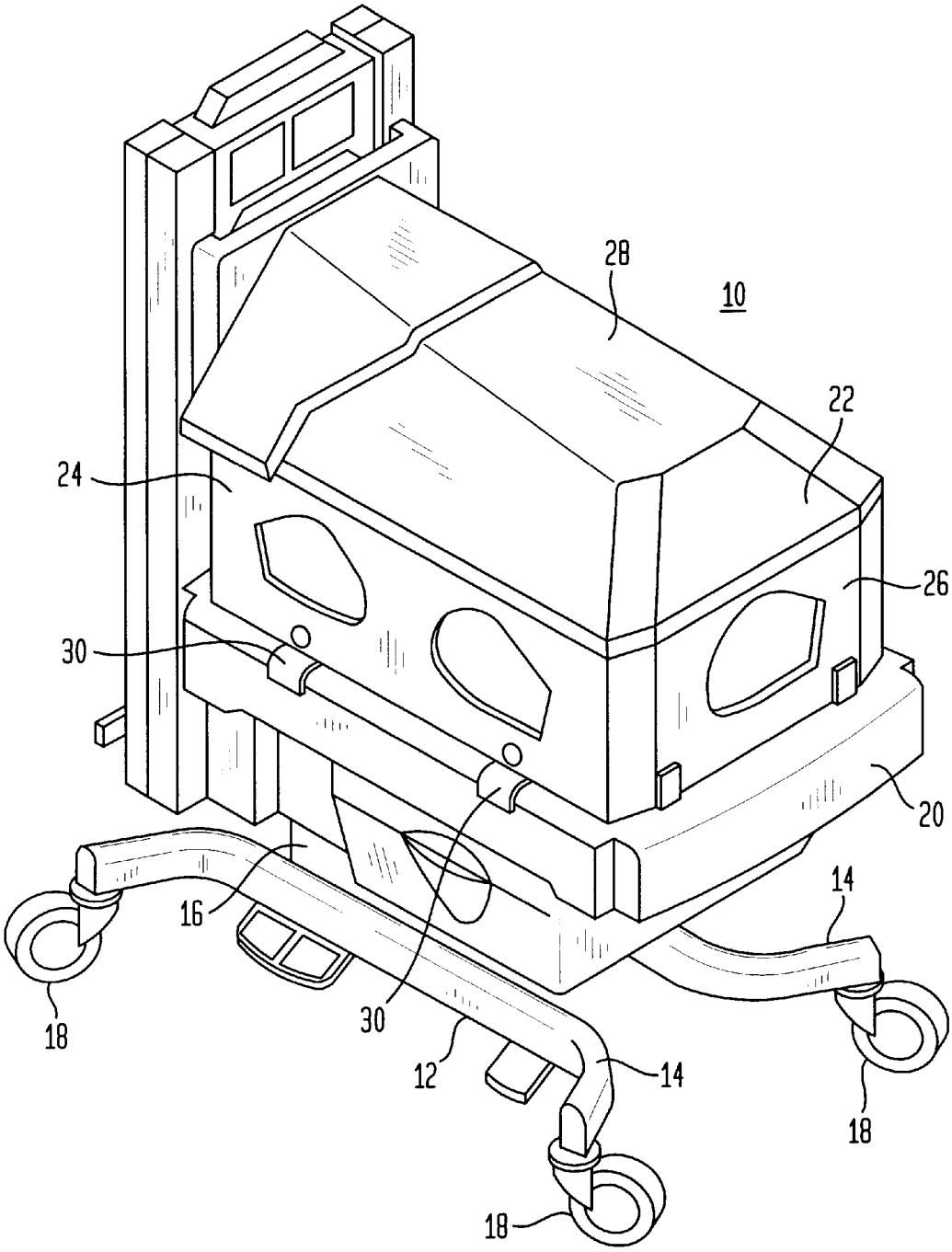
FIG. 1 is a perspective view of an infant incubator incorporating the present invention.

Referring now to FIG. 1, there is shown a perspective view of an incubator 10 constructed in accordance with the present invention. In the Figure, incubator 10 includes a base 12 comprising a pair of U-shaped members 14 that are joined together and which provide support to a base member 16. Wheels 18 may also be provided for ready movement of the infant incubator 10.

An infant platform 20 is provided and which supports an infant in the incubator 10 and the infant platform is mounted on the base member 16. The incubator 10 also includes walls to enclose therein an infant compartment 22 within which the infant is positioned during use. As can be seen, there are side walls 24, only one of which is shown and an end wall 26. Also included with the incubator 10 is a hood 28 to complete the enclosing of the infant within infant compartment 22.

The side walls 24 are affixed to the infant platform 20 by means of hinges 30 so that the side walls 24 can be opened by the user to gain access to the infant within the incubator 10 or for simply placing the infant within the incubator or removing the infant therefrom.

Figure 2:
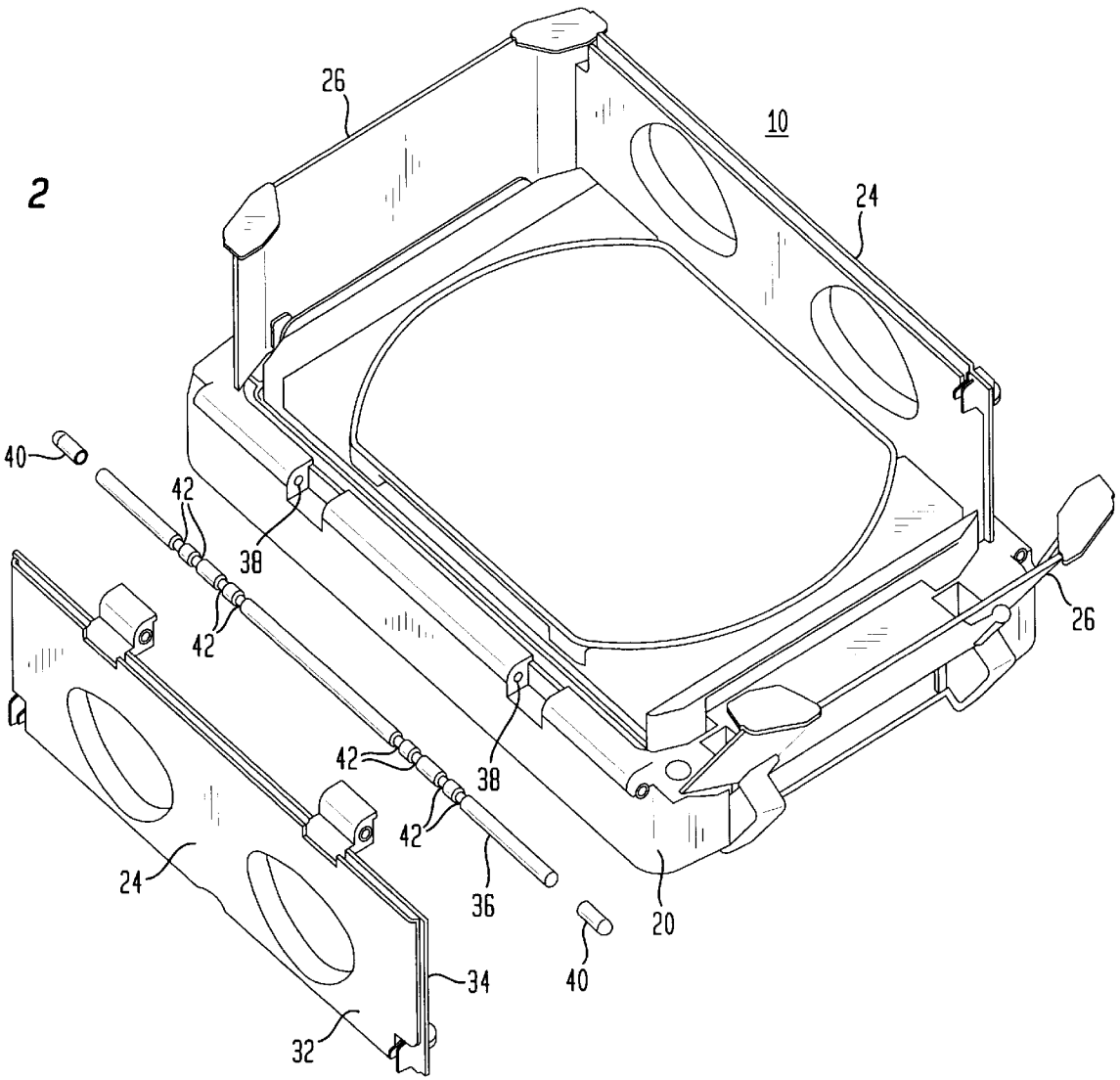
FIG. 2 is a partially exploded view of the incubator of FIG. 1 of the components used in the present invention.

Turning now to FIG. 2, there is shown a partially exploded view of the incubator 10 having the side wall 24 removed and, as can be seen, the side wall 24, in the preferred embodiment, is a double wall construction, that is, there is an inner wall 32 and an outer wall 34 so that a flow of heated air can pass between the walls somewhat in the fashion as shown and described in U.S. Pat. No. 4,936,824 of Koch et al. The hinges 30 thus hold the inner and outer walls 32 and 34 together and pivotally affix the side wall 24 to the infant platform 20 as will be explained.

A bar 36 is provided that passes through holes 38 formed in the infant platform 20 when assembled and push buttons 40 are located at both external ends of the bar 36. There are a plurality of grooves 42 formed in the bar 36 and which allow the easy assembly and disassembly of the side wall 24 to the infant platform 20 as will be explained.

Figure 5:
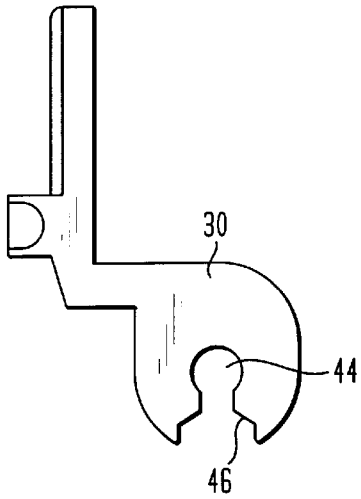
FIG. 5 is a side view of one of the components used in the present invention.

Turning briefly to FIG. 5, there is a side view of one of the hinges 30 and which has an opening 44 therethrough. That opening 44 is circular and has an internal diameter approximately the same as the outside diameter of the bar 36 so that the bar 36 can pass through and hold the hinges 30 to the infant platform 20. As also can be seen, the hinge 30 also has a cut away pie shaped section 46 that provides access to the opening 44. The openings 44 are formed in the hinge 30 at the two protrusions or ends 48,50 (FIGS. 3A and 3B) of the hinge and the center portion of the hinges 30 are open. Basically the protrusions 48, 50 are referred to as ends and are basically flanges that extend outwardly from the hinges 30 and are spaced apart. The purpose of the openings 44 in the ends 48, 50 of the hinge 30 as will be later explained.

Figure 3A:
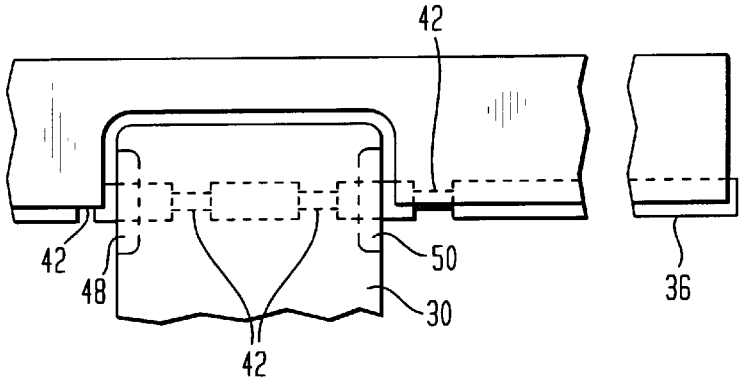
FIGS. 3A and 3B are enlarged side views of a mechanism used in accordance with the present invention.
Figure 3B:
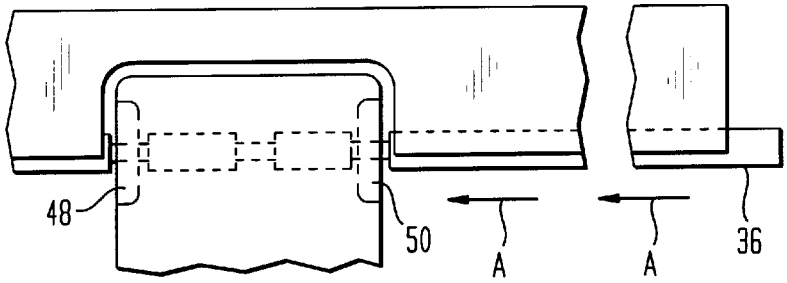

Turning then to FIGS. 3A and 3B, there is shown an enlarged side view of the hinges 30 affixed to the infant platform 20 in FIG. 3A and positioned to be disengaged from the infant platform 20 in FIG. 3B. Taking FIG. 3A first, it can be seen that the bar 36 is positioned such that the grooves 42 are located to the sides of both of the ends 48 and 50 of the hinge 30 so that the larger diameter of the bar 36 is passing through the openings 44 in those ends 48, 50. In this position, the bar 36 is firmly holding the side wall 24 pivotally to the infant platform 20.

In FIG. 3B, however, the bar 26 has been shifted in the direction of the arrows A the thus the grooves 42 and now in alignment with the openings 44 in the ends 48, 50 and the reduced diameter of the grooves can pass through the pie shaped sections 46 in the ends 48, 50 of the hinges 30 so that the side wall 24 can be easily removed.

It should be noted that the grooves 42 are such that the bar 36 can be shifted in either direction, that is, the bar 26 can be shifted in the direction of the arrows A or in a direction opposite to the arrows A and in either case, there are grooves 42 formed in the bar 26 that can align with the protrusions or ends 48, 50 for the easy removal of the side wall 24.

Thus by simply activating either of the pushbuttons 40 that are located exterior of the incubator 10 and on opposite sides thereof and readily available to the user, the user can simply move the bar 32 as desired to free the hinges 30 and thus remove the side wall 24 from the incubator.

Figure 4:
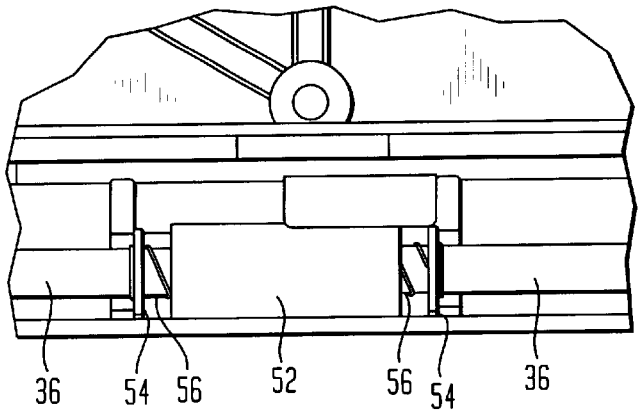
FIG. 4 is an enlarged side view of a portion of the present invention.

A bias is also provide to make sure the bar 26 stays safely in its position of FIG. 3A securing the side wall 24 to the incubator 10. The biasing means is shown in FIG. 4 which is an enlarged side view of that mechanism. In the figure there is a stop 52 that is secured to the bar 36 and is located between a pair of flanges 54. Springs 56 are located between the stop 52 and each of the flanges 54 so that the bar 36 can be moved in either direction against a spring bias by springs 56 and will return to the neutral position which is, of course, the position where the side wall 24 is securely affixed to the infant platform 20.

Figure 6:
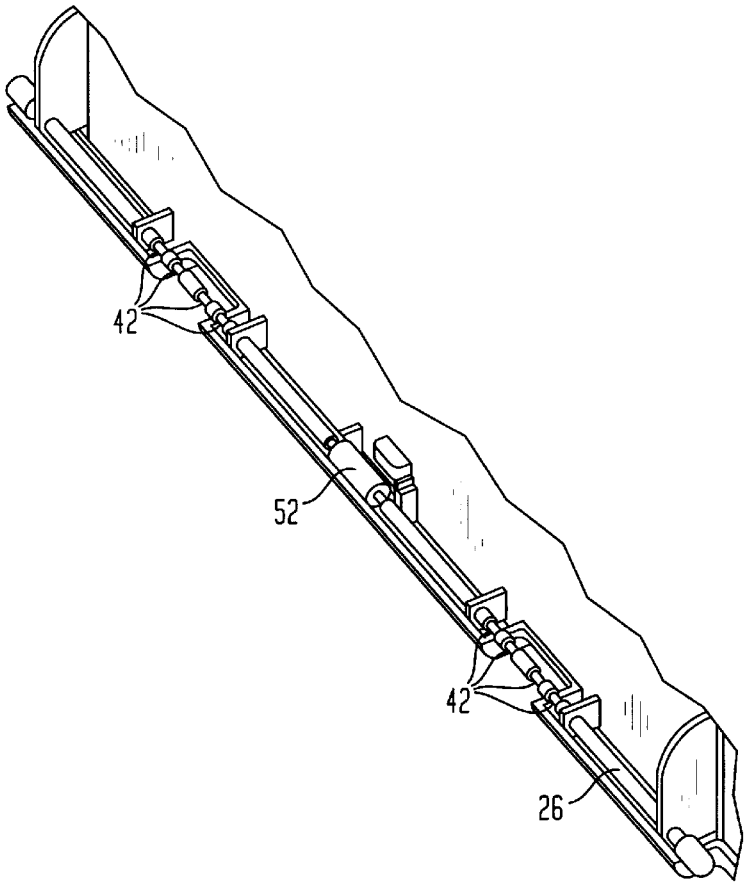
FIG. 6 is a partial sectional view of the mechanism of the present invention.

Finally, turning to FIG. 6 there is shown a perspective view of the bar 26 installed in the incubator 10 and illustrating the location of the sets of grooves 42 that allow the ready removal of the side walls 24. As can be seen, the pushbuttons 40 are located at both of the ends of the bar 26 and thus are located at both sides of the incubator so that the user can use either hand to push the bar 26 in either direction to move that bar 26 to free the side wall 24 and to release the bar 26 to allow the spring bias to return the bar 26 to its neutral position. If, of course, the side wall 24 is in the proper position, the returning of the bar 26 to its neutral position will again firmly lock the side wall 24 to the incubator 10.

Those skilled in the art will readily recognize numerous adaptations and modifications which can be made to the infant care apparatus of the present invention which will result in an improved control system, yet all of which will fall within the scope and spirit of the present invention as defined in the following claims. Accordingly, the invention is to be limited only by the following claims and their equivalents.

We claim:

1. An infant care apparatus, said apparatus comprising a infant platform and a door pivotally mounted to said infant platform, said door having at least one hinge extending outwardly from said door and having a protrusion having a bore formed as a substantial circle with an internal diameter and an opening extending outwardly from said bore, a cylindrical bar having a predetermined diameter affixed to said infant compartment, said cylindrical bar having a plurality of spaced apart grooves, said predetermined diameter of said bar adapted to fit snugly within said bore to be retained therein, said grooves adapted to pass through said opening, wherein said door is affixed to said infant compartment when said cylindrical bar is within said bore and said door is removable from said cylindrical bar when said grooves are aligned with said protrusions, said cylindrical bar adapted to move axially to a position where said grooves are aligned with said protrusions whereby said door is removable from said cylindrical bar and to a position where said bar is positioned within said protrusions wherein said door is firmly affixed to said cylindrical bar.

2. An infant care apparatus as defined in claim 1 wherein said cylindrical bar has a center position holding said door to said infant platform and is movable axially in both directions to align said grooves with said bores in said protrusions.

3. An infant care apparatus as defined in claim 2 wherein said bar is biased to said center position.

4. An infant care apparatus as defined in claim 1 wherein said at least one hinge comprises two hinges.

5. An infant care apparatus as defined in claim 1 where said protrusion comprises a pair of spaced apart protrusions.

6. An infant care apparatus as defined in claim 1 where said infant care apparatus comprises an infant incubator.

7. An infant care apparatus, said apparatus comprising a infant platform and a door pivotally mounted to said infant platform, said door having a pair of hinges extending outwardly from said door and each of said hinges having spaced apart protrusions, each of said protrusions having a bore formed as a substantial circle with an internal diameter and a pie shaped opening extending outwardly from said bore, a cylindrical bar having a predetermined diameter movable affixed to said infant compartment, said cylindrical bar having a plurality of spaced apart grooves, said predetermined diameter of said bar adapted to fit snugly within said bore to be retained therein, said grooves adapted to pass through said opening, wherein said door is affixed to said infant compartment when said cylindrical bar is within said bore and said door is removable from said cylindrical bar when said grooves are aligned with said protrusions, said cylindrical bar adapted to move axially to a position where said grooves are aligned with said protrusions whereby said door is removable from said cylindrical bar and to a position where said bar is positioned within said protrusions wherein said door is firmly affixed to said cylindrical bar.

8. An infant care apparatus as defined in claim 7 wherein said infant care apparatus is an infant incubator.

9. An infant care apparatus as defined in claim 7 wherein said cylindrical bar has two sets of four grooves.

* * * * *